United States Patent [19]

Kardas

[11] 4,452,566

[45] Jun. 5, 1984

[54] REACTIVE IMPELLER FOR PRESSURIZING HOT FLUE GASES

[75] Inventor: Alan Kardas, Chicago, Ill.

[73] Assignee: Institute of Gas Technology, Chicago, Ill.

[21] Appl. No.: 273,346

[22] Filed: Jun. 15, 1981

[51] Int. Cl.[3] ..... F04D 29/58

[52] U.S. Cl. ..... 415/81; 415/115; 415/80; 416/20 R

[58] Field of Search ..... 416/20 R; 415/80, 115, 415/82, 81; 165/DIG. 2, DIG. 11; 60/295, 316, 320

[56] References Cited

U.S. PATENT DOCUMENTS

| | | | |
|---|---|---|---|
| 1,054,758 | 3/1913 | Fornander | 415/115 X |
| 2,001,529 | 5/1935 | Dornier | 416/20 |
| 2,395,404 | 2/1946 | Goddard | 416/20 X |
| 2,612,021 | 9/1952 | Zuhn | 416/20 X |
| 2,759,700 | 8/1956 | Wheatley | 415/115 |
| 3,689,173 | 9/1972 | Morton | 415/82 |
| 4,354,801 | 10/1982 | La Baire | 415/80 |

FOREIGN PATENT DOCUMENTS

| | | | |
|---|---|---|---|
| 0546294 | 11/1922 | France | 416/20 |
| 0794198 | 6/1956 | United Kingdom | 416/20 |

*Primary Examiner*—Harvey C. Hornsby
*Assistant Examiner*—Christine A. Peterson
*Attorney, Agent, or Firm*—Allegretti, Newitt, Witcoff & McAndrews, Ltd.

[57] ABSTRACT

A reactive impeller for pressurizing hot flue gases. The impeller has a hub and blades exposed to the gases. The hub and blades are cooled by an internal cooling fluid, which is expelled from nozzles on the blades to drive the impeller so as to propel and pressurize the gases.

2 Claims, 3 Drawing Figures

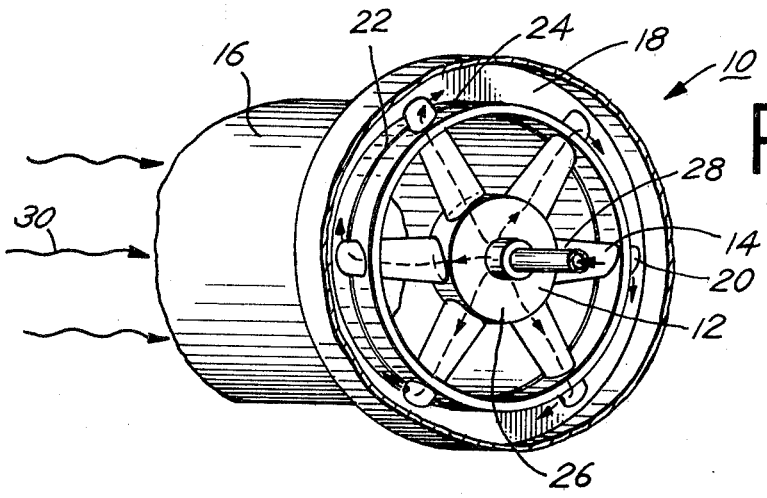
Fig. 1
Fig. 2
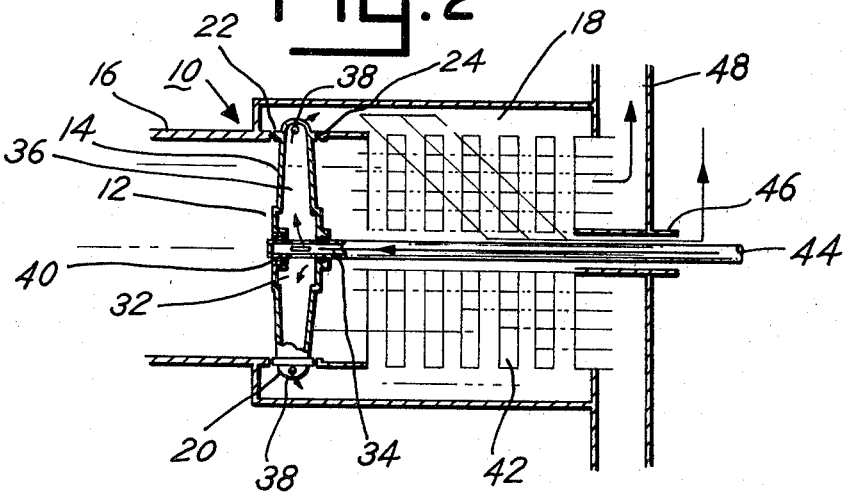
Fig. 3
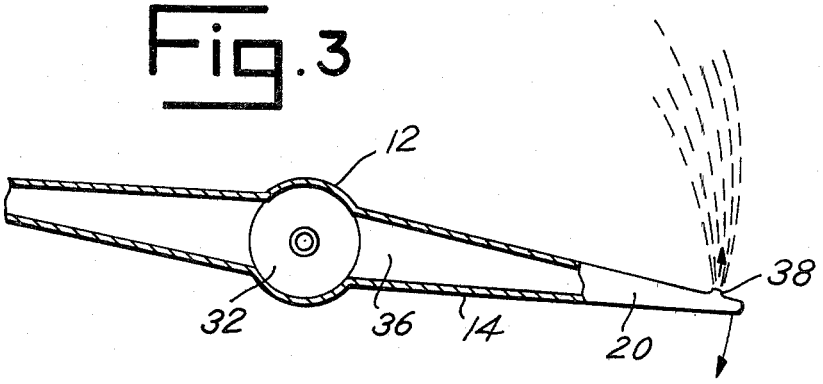

REACTIVE IMPELLER FOR PRESSURIZING HOT FLUE GASES

BACKGROUND OF THE INVENTION

This invention relates to a means of pressurizing hot flue gases so that the gases can be moved through a heat recovery device and more specifically, to a reactive impeller for pressurizing hot flue gas.

In many energy-intensive, high-temperature industrial processes operating in a range of temperature from about 2000° Farenheit (F.) to 3800° F., products of combustion are rejected as flue gases. These gases frequently have a temperature of about 2000°-2200° F. or more. As a result, flue gases frequently carry off more than half the heating value of the combustion reactants. As an example, flue gas (fg) discarded at 2000° F. from the combustion of methane in air (a) without air preheat carries off 57.3% of the gross heating value of the fuel. Only the fraction $f_a$ of the gross heating value of the fuel has done useful heating, where:

$$f_a = \frac{1hv}{hhv} - \frac{1}{hhv}\left( r_{fg} i_{fg} \Big|_{77}^{t_{fg}} + x r_a i_a \Big|_{77}^{t_{fg}} - r_a i_a \Big|_{77}^{t_{a,preh}} \right),$$

$$i \Big|_{t_1}^{t_2} = \int_{t_1}^{t_2} c_p(t)dt,$$

$r_{fg} = \dot{m}_{fg}/\dot{m}_f = r_a + 1$, and x is the excess air fraction, as for instance, in $CH_4+(1+x)2(O_2+3.76\ N_2)=CO_2+2H_2O+2xO_2+(1+x)7.52\ N_2$. Operating at 110% theoretical air, without preheat, $x=0.1$, $r_a=17.16(1+x)=18.876$, $r_{fg}=19.876$, hhv=23,875 Btu/lb, and $$f_a = \frac{21{,}495}{23{,}875} - (19.876 \cdot 573.9 + 0.1 \cdot 17.16 \cdot 510)/23{,}875 = 0.386.$$

Therefore, 100%(1−0.386)=61.4% of the gross heating value of the flue is lost.

Recovery of this residual energy is obviously desirable. The thermodynamically most efficient way to recover the energy is by preheating the combustion reactants. For instance, preheating the 110% theoretical air to 1400° F. results in adding to the previously computed value of $f_a$ the term $$\left( r_a i_a \Big|_{77}^{1400} \right) / hhv$$

or 18.876(340)/23,876=0.269.

$$f_a = 0.9 - 0.514 + 0.269 = 0.655$$

In this way, 65.5% of the hhv of the fuel is available to the process and only 34.5% is lost. A most effective preheating device is a continuously-operating recuperator. However, in many processes, such as the combustion process in direct-fired industrial furnaces, the gases have a near-zero static pressure. As a result, no pressure potential exists for moving the gas through the recuperator. Conventional solutions for the problem thus presented are chimneys and eductors, i.e., jet pumps. These ordinary means of moving hot gases are grossly inefficient. For example, the thermal efficiency of a chimney is generally a fraction of one percent. An unconventional solution would be a fan or blower, as commonly used for low temperature gases. Such a device would permit the use of a continuous heat recuperator and thereby surpass the thermal efficiency of the chimney by a ratio of about 100 to 1.

For a fair comparison of the chimney, eductor and fan, the power produced by each device, i.e., the generated pressure rise ΔP multipled by the volume flow rate $\dot{V}$, $\Delta p\dot{V}$, is divided by the rate at which thermal energy is supplied to the system before it is upgraded to shaft power or the power of the entraining jet. An elementary calculation for each device is as follows.

The Chimney Of Height H:

Driven by the buoyant force due to the temperature excess Δt of the flue gas over the ambient air, the efficiency η is as follows:

$$\eta = \frac{\Delta p \dot{V}}{c_{p,fg}\rho_{fg}\dot{V}\Delta t} = \frac{\rho_{air}H(1 - T_a/T_{fg}) \cdot g}{c_{p,fg}\rho_{fg}\Delta t \cdot g_c} = \frac{H}{778 c_{p,fg} T_{air}};$$

where $c_p$ is specific heat at constant pressure, Btu/lbm °F.; $g_c$ is a conversion factor 32.2 (lbm) (f)/lbf/sec$^2$, ρ is density, lbm/ft$^3$; and T is absolute temperature.

For $T_{air}=537°$ R, $c_{p,fg}=0.26$, η (in %)=H/1000. This means that a 400-ft stack is only 0.4% efficient as a "mover" of gas.

The Jet Pump:

A modern annular jet pump may have an efficiency of up to 50%, although efficiencies of 20-40% are much more likely. Assuming that the driving stream is powered by an 80%-efficient compressor driven by a 35%-efficient electric motor, η=(0.4)(0.8)(0.35)100%=11%.

The Fan:

A well-designed axial-flow fan or blower can approach 80% air-power-to-shaft-power efficiency. Allowing for 35% efficiency in generating electricity, η=0.8(0.35) 100%=28%.

Roughly, then, the energy efficiencies of the three different means of pressurizing, or imparting momentum to, a hot stream of flue gas are in the ratio 1 to 30 to 100 (stack to jet pump to fan). A mechanically driven fan is clearly superior, were it not for the high temperatures involved. However, while energy efficient, the fan or blower would have its blades present in the flue gases, at blade temperature of 2000° F. or more. Since even advanced and exotic turbine-blade alloys soften, flow and melt above 1750°-1800° F., the common fan could not withstand the heat of 2000° F. flue gases even if refined with exotic-blade alloys.

To explain, iron softens or melts at 2822° F., nickel at 2677° F., and while most nickel-based alloys melt between 2190° and 2370° F., their tensile (rupture) strength deteriorates rapidly above 1500° F. Strength curves of Incoloy 901 (0.04% C, 13 Cr, 3 Ti, 2 Al, 6 Mo, 42 Ni, balance Fe) end at 1300° F. Generally, rupture stress data for steel alloys are not given for temperatures in excess of 1700°-1750° F. Nimonic 115 (15% Cr, 4 Ti, 5 Al, 15 Co, 3.5 Mo, balance Ni; ρ=499, a recent British turbine blade alloy) shows 12,000 psi rupture stress at 1832° F. after only 100 hours.

Extrapolating from the available temperature ranges (a procedure not recommended in high-temperature fan design) for annealed 2.25 Cr-1 Mo steel to 1800° F. one can obtain a Larson-Miller parameter P=45 and a rupture stress of 900 psi (nominal life to rupture 1 hour). Steel alloys used in reactor tubes such as the centrifugally cast 310 NK have been tested at 1900° F. and P=56, exhibiting a $10^4$ hr rupture stress of 1250 psi. This rupture stress level for Incoloy is found at 1740° F.

An estimate of stresses developed in high temperature fans may be obtained by considering a 1-ft long impeller blade on a 2-ft diameter hub to be a straight rod with a uniform cross-section. At 1000 rpm (209 ft/s tip speed), the stress at the root of the blade will be $$\sigma_{max} = \frac{485(209)^2(1 - 2^2/4^2)}{2(32.2)(144)} = 1710 \text{ psi},$$

in excess of the rupture stress of almost any high-alloy steel at temperatures 1800° F. and higher. The maximum root stress may be reduced by tapering the profile, but the use of a safety factor (commonly 2 to 2.5) again puts it beyond a practical operating limit.

The situation up to the time of the invention has, therefore, been that unfortunately large quantities of heat energy have been locked in hot flue gases, unavailable to an energy-starved world.

SUMMARY OF THE INVENTION

It is, therefore, an object of the invention to provide a means for pressurizing hot flue gases.

More specifically, it is an object to provide a means for pressurizing flue gases having a temperature of 2000°–2200° F. or more and a near-zero static pressure, so that the gases can be moved through a heat recovery device.

Another object is to provide a pressurizing means which supplies sufficient pressure to the gas to permit use of a continuous heat recuperator and thereby improve upon the thermal efficiency of the chimney by a ratio of about 100 to 1.

Still another object is to provide a pressurizing means which is continuous and scaled to pressurize the hot flue gases of continuous, industrial-scale, high temperature processes.

A further object is to provide a pressurizing means which is economical of manufacture, operation and maintenance.

These and other objects and advantages are provided by the invention, which proceeds from the concept of a reactive impeller that uses a pressurized cooling fluid to simultaneously provide (a) a motive force for the impeller, to cause the impeller to propel the hot flue gases, (b) a medium for heat transfer from the impeller, and (c) a medium for heat transfer from the hot flue gases to process reactants. Thus, in a principal aspect, the present invention is a reactive impeller for pressurizing hot flue gases comprising an impeller hub and impeller blades. The hub has an exterior hub surface and the blades have exterior blade surfaces, all of which are in contact with the hot flue gases. The exterior blade surfaces are shaped to propel the hot flue gases past the impeller upon rotational motion of the impeller.

The hub defines a cooling chamber and cooling chamber inlet; the blades define cooling passages and nozzles. The chamber, inlet, passages and nozzles are all sealed from the hot flue gases and form a fluid pathway. The inlet opens to the chamber for introducing a cooling fluid to the cooling chamber, the passages open to the chamber for transfer of the fluid to the passages, and the nozzles open to the passages for expulsion of the fluid from the passages. The chamber receives the fluid from the inlet to cool the exterior hub surface, and the passages receive the fluid by transfer from the chamber to cool the exterior blade surfaces. The nozzles are directed to provide rotational driving motion to the impeller in reaction to expulsion of the fluid through the nozzles.

Thus, the impeller is driven to pressurize the hot flue gases and the exterior surfaces are simultaneously cooled to withstand the hot flue gases by passage of the fluid through the impeller.

BRIEF DESCRIPTION OF THE DRAWING

The accompanying drawing consists of three figures briefly described as follows:

FIG. 1. FIG. 1 is a perspective view of the preferred embodiment of the invention in operation, positioned within a hot gas flue and a surrounding cooling fluid plenum.

FIG. 2. FIG. 2 is schematic view of the preferred embodiment of the invention, as used in a combustion reactant preheat system.

FIG. 3. FIG. 3 is a schematic view of a blade of the preferred embodiment of the invention, illustrating the principle of movement of the blade in reaction to expulsion of a cooling fluid.

DETAILED DESCRIPTION OF THE PREFERRED EMBODIMENT

Referring to FIG. 1, the preferred embodiment of the invention is a reactive impeller 10. The impeller has an impeller hub 12 and impeller blades 14. The impeller is located in a cylindrical hot gas flue 16, which is surrounded by a plenum 18. The hub 12 is centered in the flue 16 and tips 20 of the impeller blades 14 extend through an impeller blade opening 22 into the plenum 18.

The flue 16 contains the hot flue gases of an industrial process, which have a temperature of 2000°–2200° F. or more and a static pressure, absent the impeller 10, of near-zero. The plenum 18 contains a cooling fluid which is a rectant of the industrial process. The flue 16 and plenum 18 are sealed from each other by a seal 24 which extends between the blades 14 about the opening 22. The seal 24 may be of a labyrinth type or any other suitable design.

The hub 12 has a hub exterior surface 26. The blades have blade exterior surfaces 28. The surfaces 28 are defined as those portions of the surfaces of the blades 14 as are within the flue 16. Thus, the hub 12 and blades 14 have respective surfaces 26 and 28 exposed to the hot flue gases in the flue 16.

The impeller 10 is adapted to provide movement, and hence pressure, of the hot flue gases in the flue 16, with minimum resistance. Arrow 30 represents the desired movement of the gases. Movement 30 is provided by the blades 14. The exterior surfaces 28 of the blades 14 are aerodynamically shaped. The shape is such that the blades 14 propel the gases through the flue 16 past the impeller 10 when rotated about the hub 12. Resistance to movement 30 is minimized by the hub 12. The exterior surface 26 of the hub 12 is aerodynamically shaped to provide a minimum resistance to movement of the gases. Thus, the impeller 10 acts by causing translational motion of the gases through the flue 16 in response to its own rotational motion.

The impeller 10 is rotated by the cooling fluid. As shown in FIG. 2, the hub 12 defines an internal fluid chamber 32 sealed from the hot flue gases, and a chamber inlet 34. The blades 14 define internal fluid passages 36 sealed from the hot flue gases, and nozzles 38. The inlet 34 oepns into the chamber 32 to introduce fluid to the chamber 32. The passages 36 open into the chamber 32 to transfer fluid in the chamber 32 to the passages 36. The nozzles 38 open into the passages 36 to expel fluid from the passages 36. The nozzles 38 are located on the blade tips 20, within the plenum 18. As shown in FIG. 3, the nozzles 38 are directed to provide rotational propulsion to the impeller 10 in reaction to expulsion of fluid from the passages 36 into the plenum 18. Thus, a pressurized fluid introduced at the inlet 34 moves through the fluid pathways of the chamber 32 and passages 36, exits the nozzles 38 and drives the impeller 10.

The cooling fluid also cools the impeller 10 and is preheated as it moves through the chamber 32 and passages 36. That is, the chamber 32 is a cooling chamber internally adjacent the hub exterior surface 26 which provides heat transfer from the surface 26 to the fluid within the chamber 32. The passages 36 are cooling passages internally adjacent the blade exterior surfaces 28 which provide heat transfer from the surfaces 28 to the fluid within the passages 36. As a result, sufficient heat is transferred from the surfaces 26, 28 that the impeller 10, unlike conventional fans, survives in the hostile environment of the hot flue gases within the flue 16.

The impeller 10 is supported for rotation upon a bearing 40. The hub 12 is mounted on the bearing 40, which is within the chamber 32. The fluid in the chamber 32 cools the bearing 40, thereby protecting the bearing 40 as well as the surface 26.

As most preferred, the impeller 10 is adapted to be used with a continuous heat recuperator. A suitable arrangement with such a recuperator 42 is shown in FIG. 2. The cooling fluid enters the inlet 34 through an inlet tube 44, and exits the plenum 18 through the recuperator 42 and out an annulus 46. The hot flue gases move past the impeller 10 into the recuperator 42 and exit through a stack 48.

To illustrate a basic design of the impeller 10 as used with a recuperator 42, an industrial process is assumed to yield 2000° F. flue gas generated by a 10-million Btu/hour burner. The choice of a $10^7$ Btu/hr burner is an arbitrary choice of an industrial scale process. By design choice, combustion air is to be preheated to 1200° F. while the flue gas is to be rejected at 900°-1000° F.

Operating at 110% theoretical air and burning natural gas (as $CH_4$), the industrial process requires $\dot{m}_{air}=2.448$ lbm/s (1.11 kg/s) of air and produces $\dot{m}_{fg}=2.5686$ lbm/s (1.165 kg/s) of flue gas. The volumetric flow rate of the flue gas at 2000° F. is $\dot{V}_{2000}=165.7$ ft$^3$/s.

The motion of the impeller 10 is given by the following three equations:

$$v=|u-rw| \quad \text{ft/s, m/s} \qquad 1.$$

$$M=rmv/g_c \quad \text{ft-lbf, N-m} \qquad 2.$$

$$M_{ret}w=\Delta p\dot{V}-(\dot{m}v^2/2g_c \text{ ft-lbf/s, W} \qquad 3.$$

Equation 1 defines the velocities in the system: the absolute velocity v of the cooling fluid (air) at the point of leaving the nozzles 38; velocity u of the air relative to the nozzles 38 (such as would be measured by an observer on the tip 20 of a rotating blade 14 holding a Pitot tube just outside a nozzle 38. Finally, rw is the circumference (tangential) velocity of a nozzle 38 itself.

Equation 2 gives the change of the moment of momentum (equal, in a constant-speed operation, to the retarding torque, $M_{ret}$, produced by the action of the impeller blade 14 on the flue gas and by the friction force of the bearing 40).

Equation 3 states that the work done per unit time by the impeller 10 in moving the hot flue gas and in overcoming the bearing friction, $M_{ret}w$ (ft-lbf/sec, W) is equal to the power of the blade-tip jets, $\Delta p\dot{V}$, less the rate at which the kinetic energy of air is lost in expansion, $-mv^2/2g_c$.

The range of possible angular velocities w is calculated from an equation 4, obtained by eliminating u and v from equations 1, 2 and 3:

$$\frac{w}{2\pi}=n(rps)=\frac{\sqrt{2g_c}}{2\pi r}\cdot\frac{\frac{\Delta p}{\rho}-\frac{M_{ret}}{2r\rho A}}{\sqrt{\frac{M_{ret}}{r\rho A}-\frac{\Delta p}{\rho}}} \qquad 4.$$

Conversely, having fixed the angular velocity, equation 4 may be used to solve for the pressure drop across the nozzles 38 needed to balance the retarding torque $M_{ret}$.

Since the number of revolutions per second n must be positive and finite, equation 4 restricts the pressure head developed at a nozzle 38, $\Delta p/\rho$, to the following domain:

$$M_{ret}/2r\rho A<\Delta p/\rho<M_{ret}/r\rho A \qquad 5.$$

Now let the impeller 10 work on the 2000° F. flue gas supplied at the rate of $\dot{v}=165.7$ ft$^3$/sec, raising its pressure 2 inches of w.c. or 10.4 lbf/ft$^2$. Disregarding the power lost in the bearing 40, the retarding power of the flue gas is $\Delta p\dot{V}=(10.4)(165.7)=1723$ ft-lbf/s. At 750 rpm (w=78.5 radians/sec), the retarding torque is $M_{ret}=1723/78.5=21.9$ ft-lbf.

The nozzle air temperature varies depending on the degree of preheat the air receives in passing through the inlet tube 44, the hub 12 and on the number of passes (if any) within a blade 14. 300° F. air at a nozzle 38 will be used here, its density being $\rho_{air}=(0.0765)(520/760)=0.05234$ lbm/ft$^3$.

Let the impeller 10 be 4-ft in diameter with a 2-ft diameter hub 12 (blade-tip r=2), with twelve blades 14, each carrying a 1-sq. inch nozzle 38 at the tip 20, the total nozzle area being A=1/12 ft$^2$. This impeller 10 can be described in terms of the dimensionless parameters of the fan design theory by:

the volume flow coefficient $\phi=0.112$
the pressure number $\psi=1.75$
the dimensionless size $\Delta=3.4$
the dimensionless speed K=0.22.

Standard design charts place such a fan in the region of successful designs and leave open the option of axial or radial flow mode. Calculating back from the dimensionless speed K, an ideal speed of 800 to 820 rpm is obtained. With this information, the bounds set by the inequalities 5 are as follows:

$$\frac{M_{ret}}{2rA} = \frac{(21.9)(12)}{(2)(2)(.05234)} = 1255$$

for the lower bound and 2510 for the upper bound. Inequalities 5 become $1255 < \Delta p/\rho < 2510$ or $$65.7 < \Delta p < 131.4 \qquad 6.$$

This inequality means that the pressure drop across the nozzle 38 must lie within the limits given by inequality 6 to overcome the 21.9 ft-lbf torque. The choice of 750 rpm make equation 4 an equation in one unknown, $\Delta p$, which, yields a $\Delta p$ of 93.3 lbf/ft$^2$ or 0.63 psi.

A rough check is made by calculating the relative exit velocity u from the pressure drop via the Bernoulli equation. With an efflux coefficient of about 0.9, u=300 ft/s and v=300−(2)(78.5)=143 ft/s. Substituted into equation 2, this (absolute) velocity yields the rate of change of the moment of momentum equal to (2)(2.448)(143)/32.2=21.7 ft-lbf, which just about equals the momentum equal to (2)(2.448)(143)/32.2=21.7 ft-lbf, which just about equals the retarding torque of 21.9 ft-lbf, as it should.

With the impeller 10 defined as a reactive device and as a pressure-raising fan, the efficiency is calculated in the usual manner, dividing the air hp of the fan moving the hot flue gas, $\Delta p\dot{V}_{fg}=(10.4)(165.7)=1723$ ft-lbf/s by the $\Delta p\dot{V}_{air}=(93.3)(2.448)/0.0652=3406$ ft-lbf/s, the power expended by taking the 93.3 psf pressure drop at the nozzles with 150° F. air. The ratio is $$\eta = \frac{\text{gas power developed}}{\text{air power supplied}} = \frac{1723}{3406} = 0.5$$

The 50% efficiency indicated is high, considering that the impeller 10 is not designed to operate at maximum torque but is coupled to a prescribed load. The high efficiency is ascribed to the fact that the propulsive moment of momentum is developed by the mass flow rate m of air. Acting as a fan, the impeller 10 moves a volume, i.e. approximately the same mass of very hot flue gas divided by its low, 2000° F. density.

To complete the system, the recuperator 42 is designed to take 2" w.c. or less pressure drop while handling the following time-rates of heat capacity:

$$\dot{C}_{air} = c_{p,air}\dot{m}_{air} = 0.25(2.448)(3600) = 2200 \text{ Btu/hr deg F.}$$

$$\dot{C}_{fg} = c_{p,fg}\dot{m}_{fg} = 0.29(2.5686)(3600) = 2680 \text{ Btu/hr deg F.}$$

$$\dot{C}_{air}/\dot{C}_{fg} = 0.82$$

As ordinary, prior experience, trial-and-error, or computerized optimization are used to choose a heat-transfer matrix and to arrive at the recuperator size, given the thermal duty and the allowable pressure drop.

In summary, about a $\frac{2}{3}$ psi pressure drop taken by the combustion air across 1-sq inch nozzles 38 of a four-ft, twelve-bladed impeller 10 with a 2-ft diameter hub 12 can reactively drive the impeller at 750 rpm, generating a 2-inch, w.c. pressure rise in a 2000° F. flue gas. The volume flows of the flue gas and the air are those required by a $10^7$ Btu/hr combustion system burning natural gas with 110% theoretical air. The impeller 10 uses 70°–150° F. combustion air as the propulsion fluid, and its temperature does not exceed 1100° F. while handling 2000° F flue gas. Stress problems limiting the use of high-temperature rotating machinery are thereby avoided.

The principles on which the design rests are of general application and units of the type calculated above may be designed for a wide variety of thermal loads, pressure differentials, configurations, and sizes. To particularly point out and distinctly claim the subject matter regarded as invention, the following claims conclude this specification.

What is claimed is:

1. In a flue containing hot flue gases, the improvement of reactive impeller means for pressurizing the hot flue gases in the flue comprising:

an impeller hub having an exterior hub surface in the flue in contact with the hot flue gases and defining a cooling chamber and a cooling chamber inlet, the cooling chamber and inlet being sealed from the hot flue gases, the cooling chamber receiving a pressurized cooling fluid to cool the exterior hub surface and the inlet opening into the cooling chamber for introducing the cooling fluid to the cooling chamber; and impeller blades mounted on the impeller hub and extending radially outward of the hub, the impeller blades having exterior blade surfaces in the flue in contact with the hot flue gases and defining cooling passages and nozzles, the exterior blade surfaces being shaped to propel the hot flue gases along the flue past the impeller means upon rotational motion of the impeller means, the cooling passages being sealed from the hot flue gases and open to the cooling chamber for transfer of the pressurized cooling fluid from the cooling chamber to the passages to cool the exterior blade surfaces, and the nozzles being open to the cooling passages for expelling the cooling fluid from the cooling passages and being directed for providing rotational driving motion to the impeller in reaction to expulsion of the pressurized cooling fluid through the nozzles, the impeller means thereby being driven to propel and pressurize the hot flue gases, and the exterior surfaces of the impeller hub and blades being simultaneously cooled to withstand the hot flue gases by passage of the pressurized cooling fluid through the impeller means, the hot flue gases existing in a flue inside a plenum and the flue defining an impeller blade opening to the plenum, the impeller blades having blade tips extending through the impeller blade opening into the plenum and the exterior hub and blade surfaces being located within the flue, the reactive impeller means further comprising means on and between the impeller blades adjacent the blade tips for substantially sealing the impeller blade opening against leakage of the hot flue gases from the flue into the plenum.

2. A reactive impeller for pressurizing hot flue gases comprising:

an impeller hub having an exterior hub surface in contact with the hot flue gases and defining a cooling chamber and a cooling chamber inlet, the cooling chamber and inlet being sealed from the hot flue gases, the cooling chamber receiving a pressurized cooling fluid to cool the exterior hub surface and the inlet opening into the cooling chamber for introducing the cooling fluid to the cooling chamber; and impeller blades mounted on the impeller hub and extending radially outward of the hub, the impeller blades having exterior blade surfaces in contact with the hot flue gases and defining cooling passages and nozzles, the exterior blade surfaces being shaped to propel the hot flue gases past the impeller upon rotational motion of the impeller, the cooling passages being sealed from the hot flue gases and open to the cooling chamber for transfer of the pressurized cooling fluid from the cooling chamber to the passages to cool the exterior blade surfaces, and the nozzles being open to the cooling passages for expelling the cooling fluid from the cooling passages and being directed for providing rotational driving motion to the impeller in reaction to expulsion of the pressurized cooling fluid through the nozzles, whereby the impeller is driven to propel and pressurize the hot flue gases and the exterior surfaces of the impeller hub and blades are simultaneously cooled to withstand the hot flue gases by passage of the pressurized cooling fluid through the impeller, the hot flue gases existing in a flue inside a cooling fluid plenum and the flue defining an impeller blade opening to the plenum, the impeller blades having blade tips extending through the impeller blade opening into the plenum and the exterior hub and blade surfaces being located within the flue, the reactive impeller further comprising means on and between the impeller blades adjacent the blade tips for sealing the impeller blade opening from the plenum.

* * * * *